US006832823B1

(12) United States Patent
Askeland et al.

(10) Patent No.: US 6,832,823 B1
(45) Date of Patent: Dec. 21, 2004

(54) DISABLING INK EJECTION ELEMENTS TO DECREASE DOT PLACEMENT ARTIFACTS IN AN INKJET PRINTHEAD

(75) Inventors: Ronald A. Askeland, San Diego, CA (US); James A. Feinn, San Diego, CA (US); David D. Helfrick, San Diego, CA (US); Jason R. Arbeiter, Poway, CA (US); Jason Quintana, Brush Prairie, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/448,972

(22) Filed: May 30, 2003

(51) Int. Cl.[7] ..... B41J 29/38
(52) U.S. Cl. ..... 347/14; 347/19; 347/12
(58) Field of Search ..... 347/12–14, 19, 347/40–42, 49

(56) References Cited

U.S. PATENT DOCUMENTS

| | | | | | |
|---|---|---|---|---|---|
| 5,861,899 | A | * | 1/1999 | Nguyen et al. | 347/40 |
| 6,196,652 | B1 | * | 3/2001 | Subirada et al. | 347/19 |
| 6,243,109 | B1 | * | 6/2001 | Ishinaga et al. | 347/3 |
| 6,257,699 | B1 | * | 7/2001 | Tracy et al. | 347/40 |
| 6,310,640 | B1 | * | 10/2001 | Askeland | 347/41 |
| 6,773,086 | B2 | * | 8/2004 | Serra et al. | 347/12 |

* cited by examiner

*Primary Examiner*—Thinh Nguyen
*Assistant Examiner*—Julian D. Huffman

(57) ABSTRACT

The present invention includes as one embodiment an inkjet printing method for decreasing dot placement artifacts of an inkjet printhead having at least two substrates, each with overlapping and non-overlapping nozzle rows, the method including selectively disabling at least one ink ejection element associated with at least one nozzle in the overlapping nozzle rows based on a swath height error of the substrate.

32 Claims, 6 Drawing Sheets

DISABLING INK EJECTION ELEMENTS TO DECREASE DOT PLACEMENT ARTIFACTS IN AN INKJET PRINTHEAD

BACKGROUND OF THE INVENTION

Accurate dot placement of ink droplets on a print media with an ink-jet printer influences the quality of images printed on the print media. One problem that affects accurate dot placement is swath height errors of the inkjet printhead. Swath height errors are commonly produced by mechanical defects in the substrate of the printhead and can produce erroneous dot placement artifacts in the media scan axis.

To solve this problem, a variety of methods have been used to compensate for artifacts in the media scan axis. For example, one method included adjusting the media advance to match the swath height error of the particular printhead. With this approach, the selection of a single media advance correction scheme is applied to all printheads in the system.

However, this can be problematic in multi-printhead systems that have printheads with varying swath height errors. For example, in a particular printing system with multiple printheads, a first printhead may have a negative swath height error of 21 um, while a second printhead may have a positive swath height error of 15 um, and a third printhead may have no error at all. In this case, the single advance correction scheme will not correct the swath height errors for the entire printing system, but only one of the printheads.

In addition, a single advance correction may change the scaling factor of the image, which could have negative implications for line art drawing applications, such as printouts for computer aided design applications.

SUMMARY OF THE INVENTION

The present invention includes as one embodiment an inkjet printing method for decreasing dot placement artifacts of an inkjet printhead having at least two substrates, each with overlapping and non-overlapping nozzle rows, the method including selectively disabling at least one ink ejection element associated with at least one nozzle in the overlapping nozzle rows between substrates based on a swath height error of the substrates.

BRIEF DESCRIPTION OF THE DRAWINGS

The present invention can be further understood by reference to the following description and attached drawings that illustrate the preferred embodiments. Other features and advantages will be apparent from the following detailed description of the preferred embodiment, taken in conjunction with the accompanying drawings, which illustrate, by way of example, the principles of the invention.

DETAILED DESCRIPTION OF THE PREFERRED EMBODIMENTS

In the following description of the invention, reference is made to the accompanying drawings, which form a part hereof, and in which is shown by way of illustration a specific example in which the invention may be practiced. It is to be understood that other embodiments may be utilized and structural changes may be made without departing from the scope of the present invention.

Figure 1:
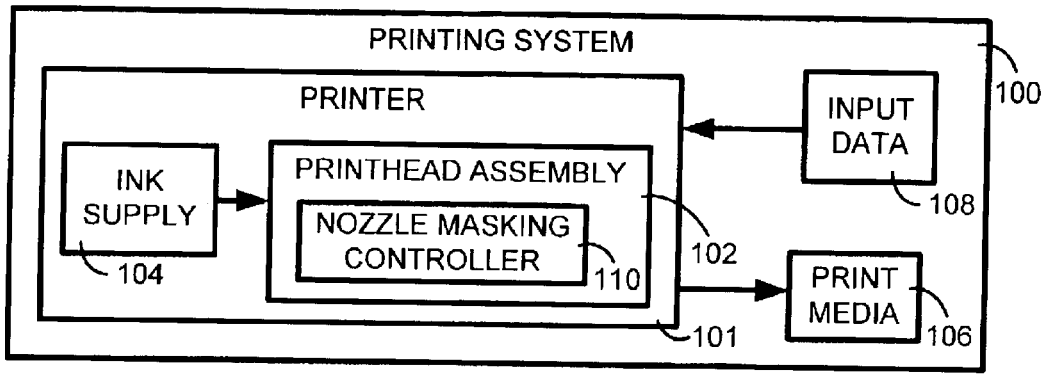
FIG. 1 shows a block diagram of an overall printing system incorporating one embodiment of the present invention.

I. General Overview:

FIG. 1 shows a block diagram of an overall printing system incorporating one embodiment of the present invention. The printing system 100 of one embodiment of the present invention includes a printhead assembly 102, ink supply or ink reservoir 104 and print media 106. At least one printhead assembly 102 and ink reservoir 104 are typically included in a printer 101. Input data 108 is sent to the printing system 100 and includes, among other things, information about the print job.

The printhead assembly 102 further includes at least two overlapping substrates (not shown), such as semiconductor wafers or dies. The printhead assembly 102 may be comprised of a single device with multiple overlapping substrates. Also, the printing system can include multiple printhead assemblies for a wide page array printer, each with at least two overlapping substrates.

The printhead assembly 102 further includes a nozzle masking controller 110 that sends instructions to selectively disable at least one ink ejection element associated with at least one nozzle in overlapping nozzle rows between substrates based on a swath height error of the substrate to reduce the artifacts caused by the swath height error. The nozzle masking controller 110 can also be implemented as firmware and/or hardware incorporated into the printer in a master controller device (not shown), or physically integrated with the printhead assembly 102 as a printhead controller device. In addition, the nozzle masking controller 110 can be implemented by a printer driver as software operating on a computer system (not shown) that is connected to the printer 101 or a processor (not shown) that is physically integrated with the printhead assembly 102.

Each substrate or die includes plural ink ejection elements and associated ejection chambers for releasing the ink through corresponding nozzles or orifices in respective adjacent nozzle members. A single nozzle masking controller 110 can control all substrates in a printhead assembly 102, or each substrate can have its own nozzle masking controller disposed thereon that is synchronized with the other nozzle masking controllers.

The substrates are preferably located adjacent to one another with overlapping and non-overlapping regions existing between each adjacent substrate. The nozzle masking controller 110 is operatively connected to the ink ejection elements of each substrate and receives and processes input data 108 to decrease dot placement artifacts by selectively disabling at least one ink ejection element associated with at least one nozzle in areas where the nozzle rows overlap between the substrates. The selective disablement is based on the swath height error of the substrate (discussed in detail below) to minimize the artifacts caused by the swath height errors, thereby improving image quality.

In general, the nozzle masking controller 110 determines the firing order of the ink ejection elements through the nozzles in the overlapping substrates. The location of a dot produced by an ink ejection element through a nozzle can be disabled in a column or row, by instructing the controller to not fire a particular ink ejection element of a particular nozzle. As such, the particular ink ejection elements that are not fired help correct for identified negative or positive swath height errors.

Figure 2:
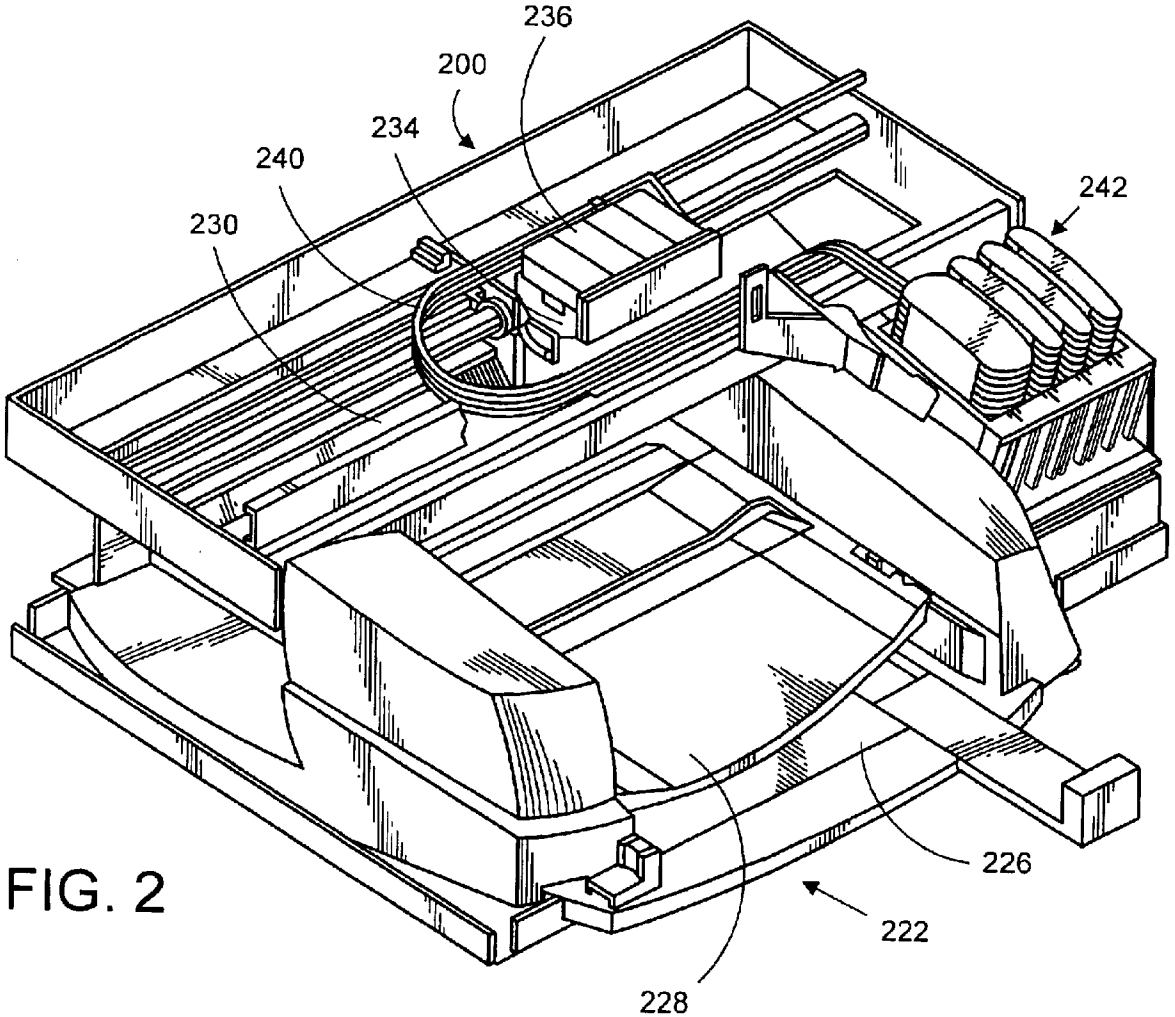
FIG. 2 is an exemplary printer usable with the system of FIG. 1 that incorporates one embodiment of the invention and is shown for illustrative purposes only.

II. Exemplary Printing System:

FIG. 2 is an exemplary embodiment of a printer that incorporates a multi-substrate or multi-die module for a single printhead assembly according to an embodiment of the invention and is shown for illustrative purposes only. As discussed above, other printers, such as a wide page array printer with multiple single-substrate printhead assemblies can incorporate embodiments of the present invention.

Generally, printer 200, which is shown in FIG. 2 as one type of printer 101 of FIG. 1, can incorporate the printhead assembly 102 of FIG. 1 and further include a tray 222 for holding print media. When printing operation is initiated, print media, such as paper, is fed into printer 200 from tray 222 preferably using sheet feeder 226. The sheet is then brought around in a U direction and then travels in an opposite direction toward output tray 228. Other paper paths, such as a straight paper path, can also be used.

The sheet is stopped in a print zone 230, and a scanning carriage 234, supporting one or more printhead assemblies 236, is scanned across the sheet for printing a swath of ink thereon. After a single scan or multiple scans, the sheet is then incrementally shifted using, for example a stepper motor or feed rollers to a next position within the print zone 230. Carriage 234 again scans across the sheet for printing a next swath of ink. The process repeats until the entire sheet has been printed, at which point it is ejected into the output tray 228.

The print assemblies 236 can be removeably mounted or permanently mounted to the scanning carriage 234. Also, the printhead assemblies 236 can have self-contained ink reservoirs which provide the ink supply 104 of FIG. 1. Alternatively, each print cartridge 236 can be fluidically coupled, via a flexible conduit 240, to one of a plurality of fixed or removable ink containers 242 acting as the ink supply 104 of FIG. 1.

Figure 3:
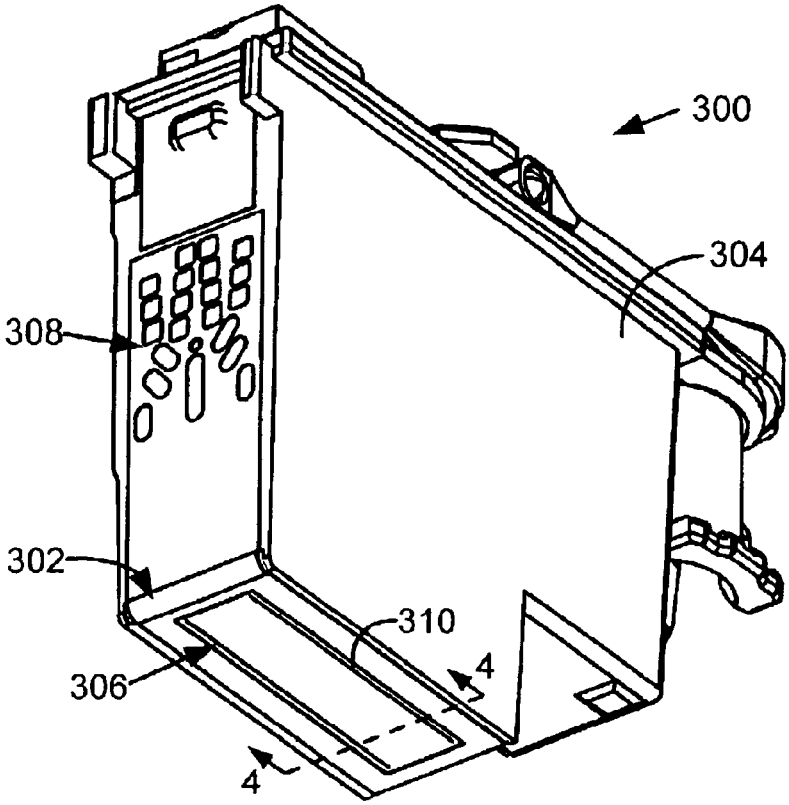
FIG. 3 shows for illustrative purposes only a perspective view of an exemplary print cartridge usable with the printer of FIG. 2 incorporating one embodiment of the printhead assembly of the present invention.

FIG. 3 shows for illustrative purposes only a perspective view of an exemplary print cartridge 300 (an example of the printhead assembly 102 of FIG. 1) that incorporates one embodiment of the invention and is shown for illustrative purposes only. A detailed description of the present invention follows with reference to a typical print cartridge used with a typical printer, such as printer 200 of FIG. 2. However, the embodiments of the present invention can be incorporated in any printhead and printer configuration.

Referring to FIGS. 1 and 2 along with FIG. 3, the print cartridge 300 is comprised of a thermal head assembly 302 and a body 304. The thermal head assembly 302 can be a flexible material commonly referred to as a Tape Automated Bonding (TAB) assembly. The thermal head assembly 302 contains a nozzle member 306 to which the plural substrates are attached to form the printhead assembly 102.

Thermal head assembly 302 also has interconnect contact pads (not shown) and is secured to the printhead assembly 300 with suitable adhesives. Contact pads 308, align with and electrically contact electrodes (not shown) on carriage 234. The nozzle member 306 preferably contains plural parallel rows of offset nozzles 310 for each substrate through the thermal head assembly 306 created by, for example, laser ablation. Other nozzle arrangements can be used, such as non-offset parallel rows of nozzles.

Figure 4:
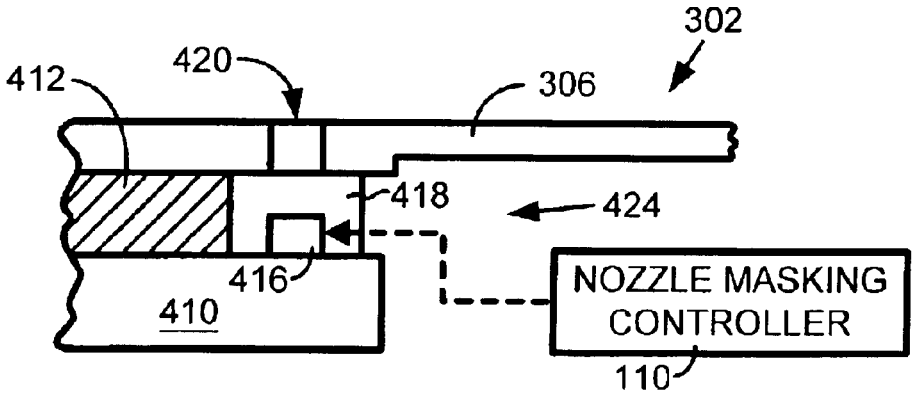
FIG. 4 is a schematic cross-sectional view taken through a portion of section line 4—4 of FIG. 3 showing a portion of the ink chamber arrangement of an exemplary printhead substrate in the print cartridge of FIGS. 1 and 3.

III. Component Details:

FIG. 4 is a cross-sectional schematic taken through a portion of section line 4—4 of FIG. 3 of the print cartridge 300 utilizing one embodiment of the present invention. A detailed description of one embodiment of the present invention follows with reference to a typical print cartridge 300. However, embodiments of the present invention can be incorporated in any printhead configuration. Also, the elements of FIG. 4 are not to scale and are exaggerated for simplification.

Referring to FIGS. 1–3 along with FIG. 4, in general, the thermal head assembly 302 includes at least two overlapping substrates 410 (a single substrate is shown in FIG. 4 for simplicity) and a barrier layer 412 located between the nozzle member 306 and each substrate 410 for insulating conductive elements from the substrate 410, and for forming a plurality of ink ejection chambers 418 (one of which is shown). The plural substrates are located adjacent to one another with overlapping and non-overlapping regions existing between each substrate.

Also included is a corresponding plurality of ink ejection elements 416 disposed on the substrate 410. The nozzle masking controller 110 is operatively connected to the ink ejection elements 416. Each chamber 418 is associated with a different one of the ink ejection elements 416. The nozzle masking controller 110 receives print data and processes the print data to decrease dot placement artifacts by selectively disabling certain ink ejection elements of certain nozzles in an overlapping region based on a swath height of the substrate to minimize the artifacts caused by swath height errors, thereby improving image quality.

An ink ejection or vaporization chamber 418 is adjacent each ink ejection element 416 of each substrate 410, as shown in FIG. 4, so that each ink ejection element 416 is located generally behind a single orifice or nozzle 420 of the nozzle member 306. Thus, each ink ejection element 416 is associated with, and ejects ink from, a corresponding nozzle 420. The nozzles 420 are shown in FIG. 4 to be located near an edge of the substrate 410 for illustrative purposes only. The nozzles 420 can be located in other areas of the nozzle member 306, such as centered between an edge of the substrate 410 and an interior side of the body 304.

The ink ejection elements 416 may be resistor heater elements or piezoelectric elements, but for the purposes of the following description, the ink ejection elements may be referred to as resistor heater elements. In the case of resistor heater elements, each ink ejection element 416 acts as an ohmic heater when selectively energized by one or more pulses applied sequentially or simultaneously to one or more of the contact pads via the integrated circuit. The orifices 420 may be of any size, number, and pattern, and the various figures are designed to simply and clearly show the features of one embodiment of the invention. The relative dimensions of the various features have been greatly adjusted for the sake of clarity.

Figure 5:
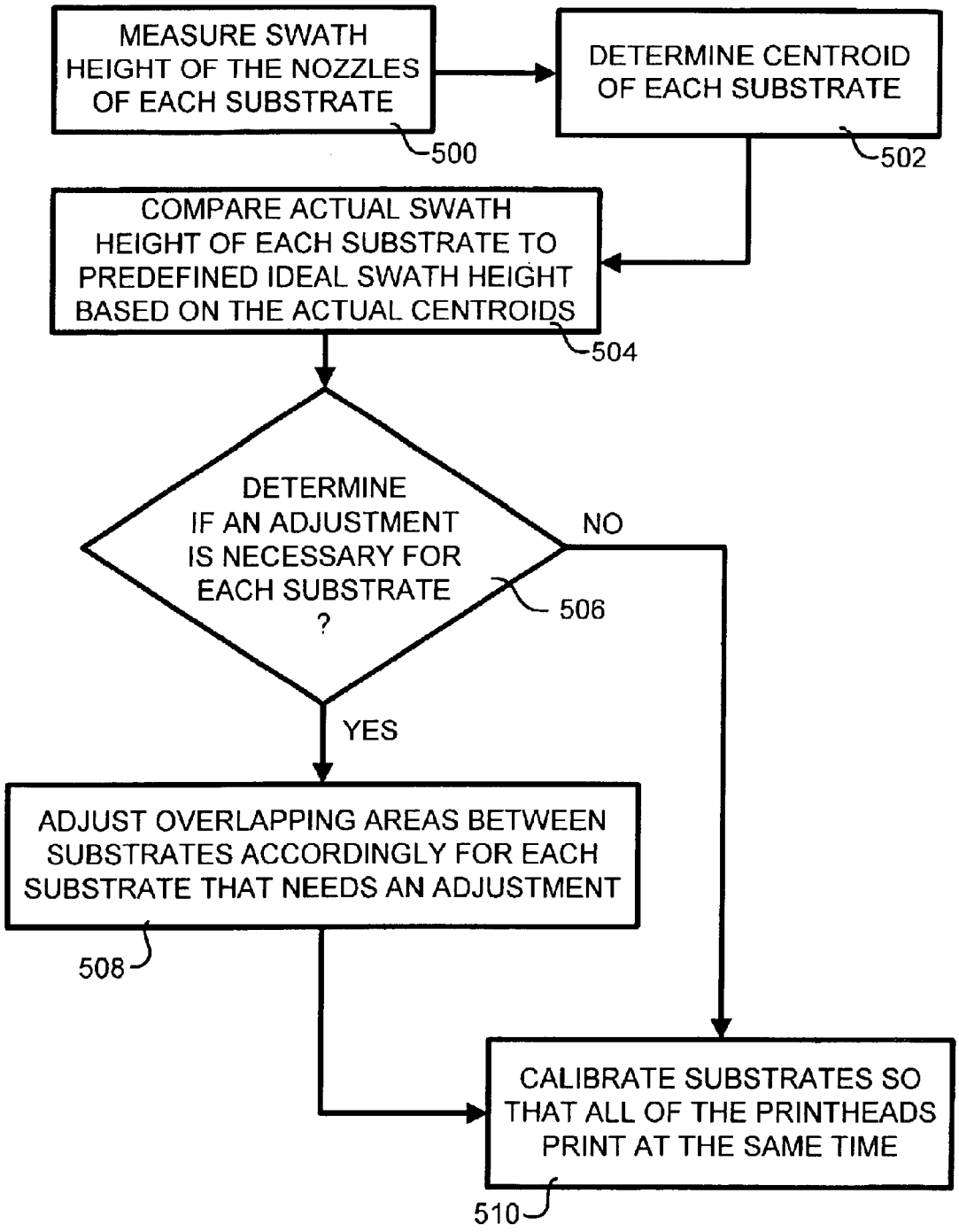
FIG. 5 is a flow diagram of the operation of a printhead assembly according to FIG. 3 that incorporates an embodiment of the present invention.
Figure 6:
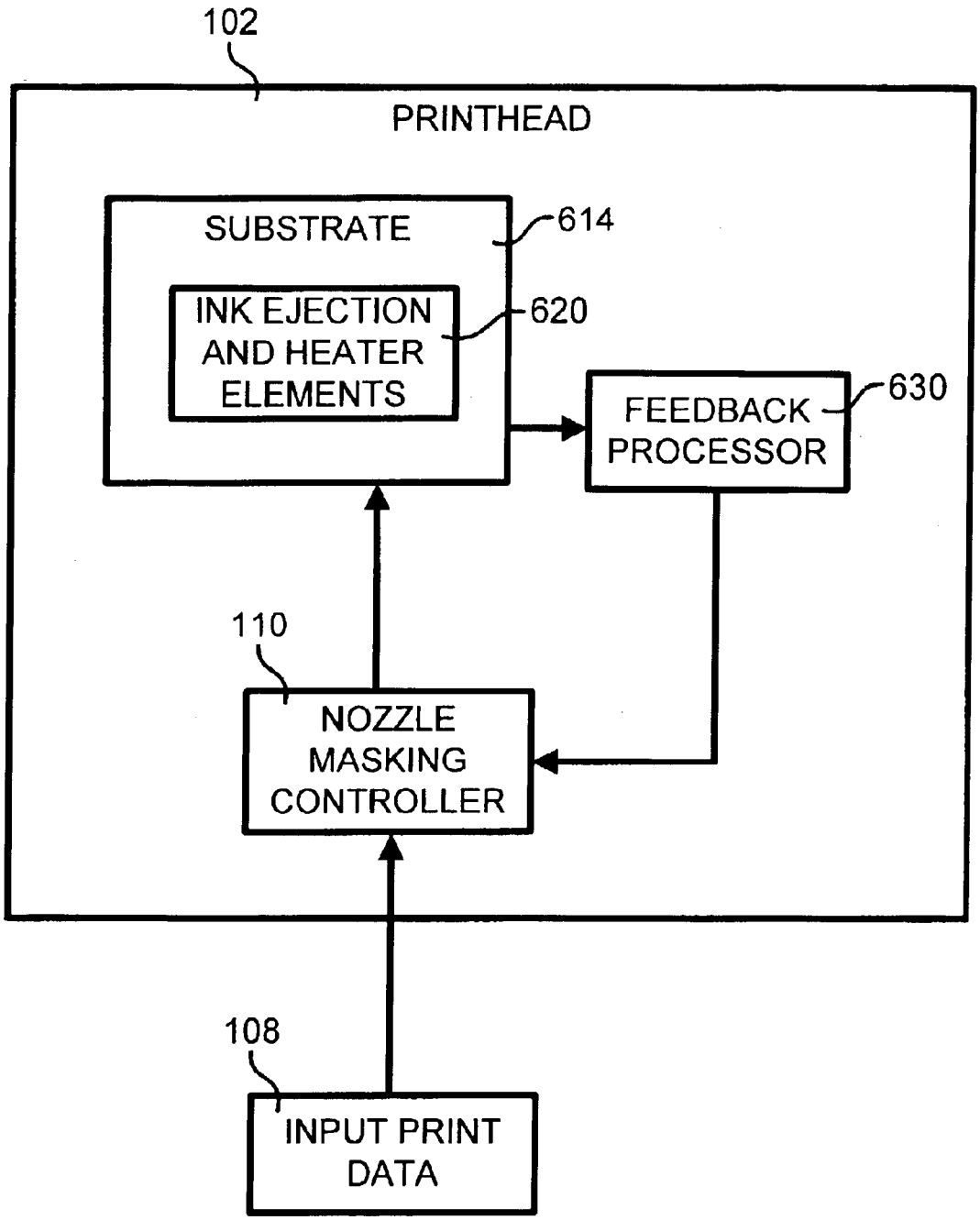
FIG. 6 is a block diagram of a printhead assembly according to FIG. 3 that incorporates an embodiment of the present invention.

FIG. 5 is a flow diagram of the operation of a printhead assembly according to FIG. 3 that incorporates an embodiment of the present invention. FIG. 6 is a block diagram of a printhead assembly according to FIG. 3 that incorporates an embodiment of the present invention. Referring to FIG. 6 along with FIG. 5, first, an actual swath height produced by each substrate 614 when printing dots is determined (step 500). This can be accomplished with an optical system with a feedback processor 630 that examines and analyzes the dots printed on the print media with an optical system with a feedback processor 630.

For example, the feedback processor 630 can have an internal scanning device for examining and analyzing in real time the dots as they leave the substrate and before they land on the print media. Alternatively, the feedback processor 630 can have an external scanning device for examining the dots after they have been printed on the print media. Further, although FIG. 6 shows a feedback processor 630 and a nozzle masking controller 110 incorporated in each printhead 102, a single feedback processor 630 and a single nozzle masking controller 110 can be external devices to each printhead and can be used to analyze and control all printheads.

Second, the centroid of each substrate is determined. The centroid can be determined by any suitable measurement device that measures certain areas and dimensions of the substrate for calculating the centroid of the substrate (step 502). For example, the centroid can be estimated by printing a pattern on page, using a sensor, such as an offline sensor or one built into the inkjet printhead or printer, and using a weighted average to determine the centroid middle of the substrate. Also, the centroid can be determined by printing drops, using an optical sensor to collect data about the drops in mid air and then using a processor to calculate the centroid based on the data. In addition, the charges on drop can be examined to determine a centroid of the substrate.

Third, the actual swath height of each substrate 614 is compared to a predefined ideal swath height based on the centroid of each respective substrate (step 504). The predefined ideal swath height is a theoretical swath height that is chosen by the manufacturer that will produce consistent and accurate ink drops.

Comparing the actual swath height to the ideal swath height based on the centroid can be accomplished by first calculating the actual number of overlapping dots at an area where the substrates overlap and then calculating the theoretical number of overlapping dots at an area where the substrates overlap using the centroids and the theoretical swath height. The difference between the overlapping dots is then calculated by subtracting the theoretical number of overlapping dots from the actual number of overlapping dots. Next, it is determined whether an adjustment is necessary (based on the severity of the swath height error) for each substrate based on a predefined unit (step 506). The centroid is found to determine how the substrates line up with each other. This determination allows the system to avoid summing errors from one substrate to the next. In other words, when the centroid of each die is located, the swath height error can be determined, which allows the system to then correct each overlap area accordingly.

In one embodiment, the unit is nozzle spacing and if the difference between the actual swath height and the ideal swath height is zero, then an adjustment is not performed. However, if the difference is greater than or equal to 1 unit or less than or equal to negative 1 unit, then the adjustment is performed, where 1 unit is equal to the spacing between consecutive nozzles for all columns of nozzles. The feedback processor 630 calculates the swath height error (which could be a negative or positive error) by comparing the actual swath height to the theoretical swath height. A negative swath height error occurs when the actual swath height is less than the ideal swath height, while a positive swath height error occurs when the actual swath height is greater than the ideal swath height.

If an adjustment is deemed appropriate, the number of nozzles per data row (for firing purposes of the ink ejection elements 620) is adjusted by the nozzle masking controller 110 according to a predefined relationship for each substrate that needs an adjustment (step 508). In the embodiment above where the difference is calculated in nozzle spacing units, if the difference is negative, the number of overlapping nozzles is increased from the actual number of overlapping dots to the theoretical number of dots.

In contrast, if the difference is positive, the number of overlapping nozzles is decreased from the actual number of overlapping dots to the theoretical number of dots. Further, if four or more nozzles are used to print a data row in the overlap region, two of the ink ejection elements that fire outer dots for that row are disabled. Last, the substrates are calibrated so that all of the printhead assemblies 102, 236, 300 print at the same time (step 510). In one embodiment, the predefined relationship of step 508 is defined by the following expression:

$$L = \left(\sum_{n=1}^{\alpha} H_n\right) - \left(\sum_{n=1}^{\alpha-1} S_n\right)$$

where L is the total length (measured in the number of nozzles) of each printhead assembly 102, H is the height of each individual substrate, S is the height of the overlap region between substrates and where $\alpha$ is equal to the total number of substrates. In the above expression, the total length L of the printhead assembly 102 is equal to the sum of the height of each individual substrate minus the overlap region between substrates.

In one example using the above expression, the swath height could be calculated from the height of a nozzle column, z, and a height of nozzle overlap, y. In the case of an exemplary four-substrate module, where each nozzle column is the same height and the nozzle overlap is equal, the swath height would equal 4z−3y.

III. WORKING EXAMPLE

Figures 7A, 7B:
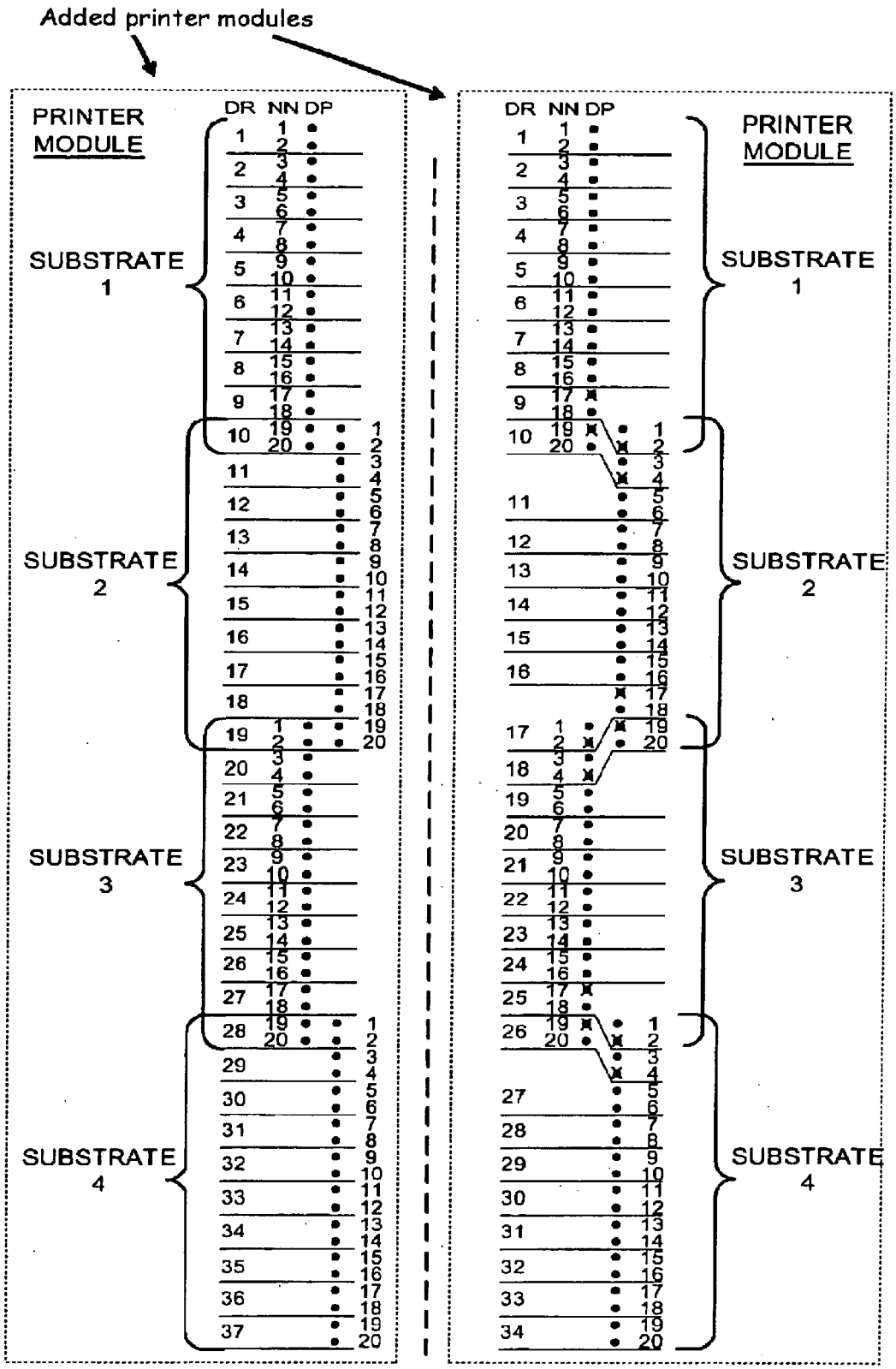
FIGS. 7A–7D illustrate working examples of the operation of a multi-substrate printhead that incorporates an embodiment of the present invention.
Figures 7C, 7D:
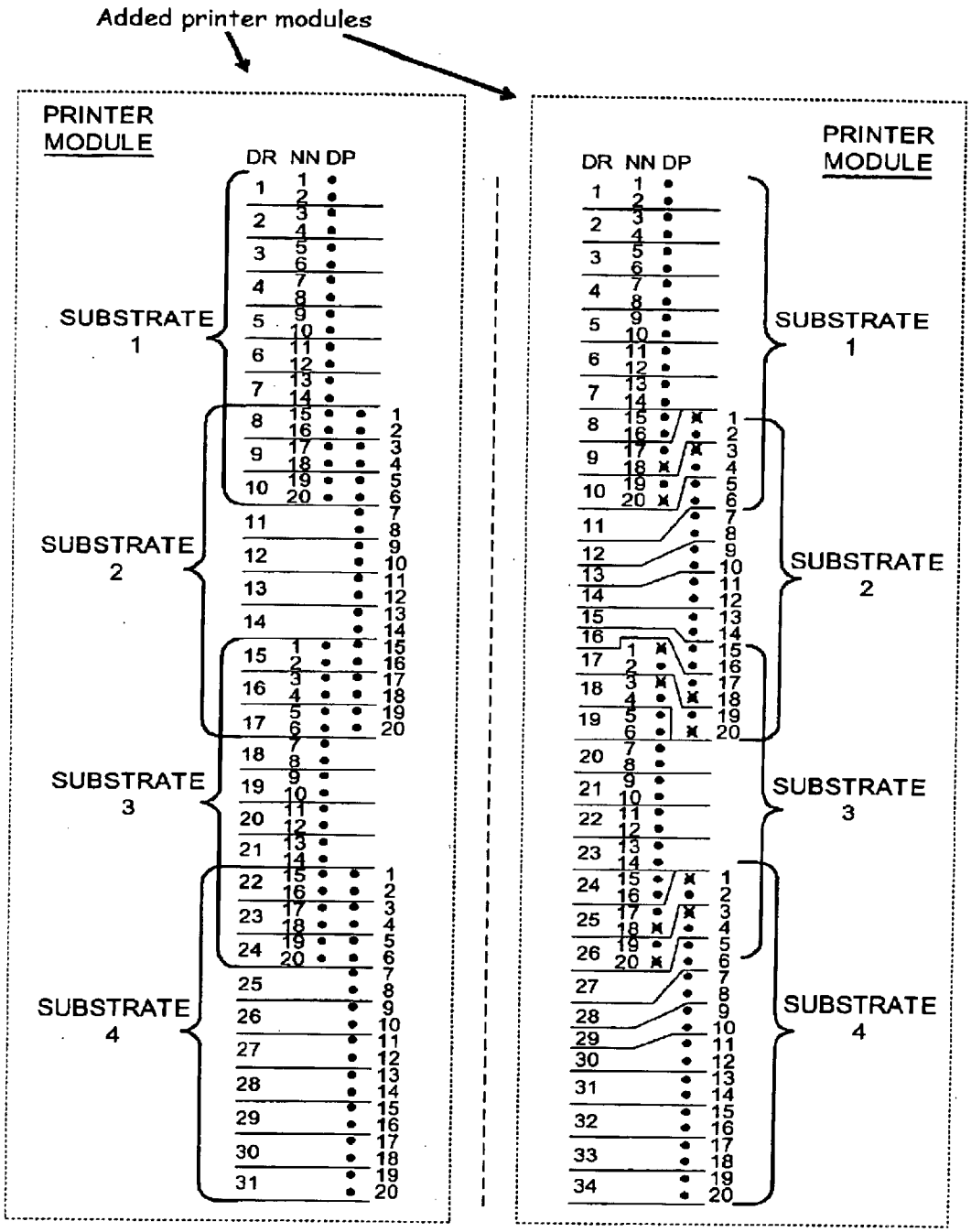

FIGS. 7A–7D illustrate working examples of printhead assemblies that incorporate embodiments of the present invention. FIGS. 7A–7D each show multi-substrate printhead assemblies, each having 4 substrates with 20 nozzles, and is shown for illustrative purposes only. Each substrate is shown with a data row (DR), nozzle number (NN) and dot position (DP). FIGS. 7A and 7C illustrate data mapping of a respective substrate with 20 nozzles before the nozzle masking controller 110 of FIG. 1 is activated. The substrate of FIG. 7A has a negative swath height error and the substrate of FIG. 7C has a positive swath height error. FIGS. 7B and 7D each illustrate data mapping of the substrates of FIGS. 7A and 7C, respectively, after the nozzle masking controller 110 of FIG. 1 is activated.

In the examples of FIGS. 7A–7D, the swath height could be calculated from the height of the nozzle column, and the height of the nozzle overlap. The swath height would equal 4 nozzle column minus 3 nozzle overlaps for an exemplary 4 substrate module, where each nozzle column is the same height and the nozzle overlap is equal. As two nozzles are printed per row, the nominal height of the column of each substrate is 10 data rows and the nominal overlap of nozzles is 4 nozzles. The ideal swath height would have a total of 34 data rows to allow 1200 dpi printed with the multi-substrate module.

In one example, assuming the multi-substrate module of FIG. 7A has an uncorrected swath height error of −73 μm with 37 data rows, each having 2 nozzle rows and 2 dot positions per data row in non-overlapping areas and 4 nozzle rows and 4 dot positions per data row in overlapping regions. The corrected swath height error is shown in FIG. 7B and is corrected by the feedback processor 630 of FIG. 6, which determines the amount of negative swath height error, and the nozzle masking controller 110 of FIG. 1, and then disables certain ink ejection element associated with certain nozzles to effectively reduce the amount of swath height error. The method of FIG. 5 can be used to correct swath height error for this example.

Namely, as shown in FIG. 7B, the data rows in the overlap region include disabled ink ejection elements associated with particular nozzles. Namely, substrate 1 includes two disabled ink ejection elements associated with the nozzles shown with an 'X' over dot positions associated with nozzle numbers 17 and 19. Similarly, substrate 2 includes two disabled ink ejection elements associated with the nozzles shown with an "X" over dot positions associated with nozzle numbers 2 and 4. Substrate 2 also includes two more disabled ink ejection elements associated with the nozzles shown with an "X" over dot positions associated with nozzle numbers 17 and 19 that overlap with substrate 3.

Similarly, substrate 3 includes four disabled ink ejection elements associated with particular nozzles, two at the overlap region with substrate 2, shown with an "X" over dot positions associated with nozzle numbers 2 and 4 and two at the overlap region with substrate 4, shown with an "X" over dot positions associated with nozzle numbers 17 and 19.

Last, substrate 4 includes two disabled ink ejection elements associated with the nozzles at the overlap region with substrate 3 shown with an "X" over dot positions associated with nozzle numbers 2 and 4. This reduces the number of data rows from 37 data rows to 34 data rows. In this example, the disablement of the ink ejection elements of associated nozzles maintains a four nozzle overlapping scheme while still reducing the swath height error of the multi-module to only −12 μm. Even though two of the four ink ejection elements associated with the nozzles in the overlap areas are disabled, redundancy is maintained since all data is printed with the two ink ejection elements associated with the nozzles that are not disabled.

For positive swath height errors, the multi-substrate module of FIG. 7C has an uncorrected swath height error of +87 μm with only 31 data rows, each having 2 nozzle rows and 2 dot positions per data row in non-overlapping areas and 6 nozzle rows and 6 dot positions per data row in overlapping regions. The corrected swath height error is shown in FIG. 7D and is corrected by the feedback processor 630 of FIG. 6, which determines the amount of positive swath height error, and the nozzle masking controller 110 of FIG. 1, and then disables certain ink ejection elements associated with certain nozzles to effectively reduce the amount of swath height error. The method of FIG. 5 can be used to correct swath height error for this example.

Specifically, as shown in FIG. 7D, the data rows in the overlap region include disabled ink ejection elements of associated nozzles. Namely, substrate 1 includes two disabled ink ejection elements associated with the nozzles shown with an "X" over dot positions associated with nozzle numbers 18 and 20. Similarly, substrate 2 includes two disabled ink ejection elements associated with the nozzles shown with an "X" over dot positions associated with nozzle numbers 1 and 3. Substrate 2 also includes two more disabled ink ejection elements associated with the nozzles shown with an "X" over dot positions associated with nozzle numbers 18 and 20 that overlap with substrate 3.

Similarly, substrate 3 includes four disabled ink ejection elements associated with nozzles, two at the overlap region with substrate 2, shown with an "X" over dot positions associated with nozzle numbers 1 and 3 and two at the overlap region with substrate 4, shown with an "X" over dot positions associated with nozzle numbers 18 and 20.

Last, substrate 4 includes two disabled ink ejection elements associated with the nozzles at the overlap region with substrate 3 shown with an "X" over dot positions associated with nozzle numbers 1 and 3. This increase the number of data rows from 31 data rows to 34 data rows. In this example, the disablement of the ink ejection elements associated nozzles maintains a four nozzle overlapping scheme while still reducing the swath height error of the multi-module to only 19.5 μm. Even though two of the four ink ejection elements associated with the nozzles in the overlap areas are disabled, redundancy is maintained since all data is printed with the two nozzles that are not disabled.

The foregoing has described the principles, preferred embodiments and modes of operation of the present invention. However, the invention should not be construed as being limited to the particular embodiments discussed. As an example, the above-described inventions can be used in conjunction with inkjet printers that are not of the thermal type, as well as inkjet printers that are of the thermal type. Thus, the above-described embodiments should be regarded as illustrative rather than restrictive, and it should be appreciated that variations may be made in those embodiments by workers skilled in the art without departing from the scope of the present invention as defined by the following claims.

What is claimed is:

1. A method for decreasing dot placement artifacts of an inkjet printhead having at least two substrates, each with overlapping and non-overlapping nozzle rows and forming a printhead module, the method comprising:

selectively disabling at least one ink ejection element associated with at least one nozzle in the overlapping nozzle rows based on a swath height error of the substrates;

disabling alternating ink election elements associated with nozzles in a data row in the overlapping region; and increasing a total number of data rows of the substrates if the swath height error is greater than or equal to 1 nozzle spacing unit wherein 1 nozzle spacing unit is equal to a spacing between adjacent nozzles.

2. The method of claim 1, further comprising firing a predefined number of nozzles per data row if the swath height error is not equal to zero.

3. The method of claim 1, further comprising decreasing a total number of data rows of the substrates if the swath height error is less than or equal to negative 1 nozzle spacing unit, wherein 1 nozzle spacing unit is equal to a spacing between adjacent nozzles.

4. The method of claim 1, further comprising calibrating the substrates so that all of the printheads print at the same time.

5. The method of claim 1, further comprising determining an actual swath height produced by each substrate.

6. The method of claim 5, further comprising comparing the actual swath height of each substrate to a predefined ideal swath height to define the swath height error.

7. An inkjet printing system, comprising:

plural substrates, each with a plurality of ink ejection elements, each ink ejection element coupled to a corresponding one of a plurality of ink ejection chambers for ejecting ink through a corresponding one of a plurality of nozzles, each nozzle for printing in a corresponding one of a plurality of nozzle rows;

a masking controller operatively connected to the ink ejection elements, the controller configured to receive and process print data to selectively disable at least one ink ejection element associated with a particular nozzle in areas where nozzle rows overlap between substrates based on a swath height error of the substrates; and a feedback processor operatively coupled to the substrate and the masking controller, the feedback processor configured to determine actual swath heights produced by the substrates.

8. The inkjet printing system of claim 7, wherein the masking controller is physically integrated with one of the substrates.

9. The inkjet printing system of claim 7, wherein the masking controller is implemented as firmware incorporated into the inkjet printing system.

10. The inkjet printing system of claim 7, wherein the masking controller is implemented by a printer driver as software operating on a computer system that is connected to the inkjet printing system.

11. The inkjet printing system of claim 7, wherein the masking controller is implemented by a processor that is physically integrated with one of the substrates.

12. The inkjet printing system of claim 7, wherein the plural substrates form multiple single substrate printhead modules.

13. The inkjet printing system of claim 7, wherein the plural substrates form a single printhead module.

14. The inkjet printing system of claim 7, wherein the plural substrates form multiple single substrate printhead modules and a single printhead module.

15. The inkjet printing system of claim 7, wherein the feedback processor is configured to compare the actual swath height of each substrate to a predefined ideal swath height.

16. The inkjet printing system of claim 7, wherein the masking controller is further configured to fire a predetermined number of nozzles per data row if the swath height error is not equal to zero.

17. The inkjet printing system of claim 7, wherein the masking controller further disables alternating ink ejection elements associated with nozzles in a data row in the overlapping region and increases a total number of data rows of the substrates if the swath height error is greater than or equal to 1 unit, wherein 1 nozzle spacing unit is equal to a spacing between adjacent nozzles.

18. The inkjet printing system of claim 7, wherein the masking controller further disables alternating ink ejection elements associated with nozzles in a data row in the overlapping region and decreases a total number of data rows of the substrates if the swath height error is less than or equal to negative 1 unit, wherein 1 nozzle spacing unit is equal to a spacing between adjacent nozzles.

19. The inkjet printing system of claim 18, wherein the inkjet printhead includes plural substrates and wherein the swath height error is adjusted in accordance with the expression:

$$L = \left(\sum_{n=1}^{\alpha} H_n\right) - \left(\sum_{n=1}^{\alpha-1} S_n\right)$$

where L is a total length measured in a number of nozzles of each printhead, H is a height of each individual substrate, S is a height of an overlap region between substrates and where $\alpha$ is equal to a total number of substrates.

20. An inkjet printhead assembly having a plurality of substrates with plural ink ejection elements, each ink ejection element, and the substrate having nozzle rows each associated with a print data row, the inkjet printhead comprising:

means for determining a swath height error of the substrate;

means for selectively disabling at least one ink ejection element associated with at least one nozzle in areas where nozzle rows overlap between substrates based on a swath height errors of the substrates to reduce the artifacts caused by the swath height errors; and means, operatively coupled to the substrate and the masking controller, for determining actual swath heights produced by the substrates.

21. A method for operating an inkjet printhead having at least two substrates with plural ink ejection elements, each ink ejection element associated with a corresponding nozzle, the method comprising:

determining an actual swath height produced by the substrate;

comparing the actual swath height to a predefined ideal swath height to define a swath height error;

selectively disabling at least one ink ejection element associated with at least one nozzle in areas where nozzle rows overlap between substrates based on a swath height errors of the substrates to reduce the artifacts caused by the swath height errors; and using a feedback processor operatively coupled to the substrate and the masking controller to determine actual swath heights produced by the substrates.

22. The method of claim 21, further comprising firing a predetermined number of nozzles per data row if a swath height error is not equal to zero.

23. The method of claim 21, further comprising disabling alternating ink ejection elements associated with nozzles in a data row in the overlapping region and increasing a total number of data rows of the substrates if a swath height error is greater than or equal to 1 unit, wherein 1 nozzle spacing unit is equal to a spacing between adjacent nozzles.

24. The method of claim 21, further comprising disabling alternating ink ejection elements associated with nozzles in a data row in the overlapping region and decreasing a total number of data rows of the substrates if a swath height error is less than or equal to negative 1 unit, wherein 1 nozzle spacing unit is equal to a spacing between adjacent nozzles.

25. The method of claim 21, wherein the at least two substrates form multiple single substrate printhead modules and further comprising calibrating all of the substrates so that all the printhead modules print at the same time.

26. The method of claim 21, wherein the at least two substrates form a single printhead module and further comprising calibrating all of the substrates so that all the printhead modules print at the same time.

27. The method of claim 21, wherein the at least two substrates form multiple single substrate printhead modules and a single printhead module and further comprising calibrating all of the substrates so that all the printhead modules print at the same time.

28. In a system for decreasing dot placement artifacts of an inkjet printhead having plural substrates each having nozzle rows each associated with a print data row, wherein the substrates form plural printhead assemblies, a computer-readable medium having computer-executable instructions for performing a process on a computer, the process comprising:

selectively disabling at least one ink ejection element associated with at least one nozzle in areas where nozzle rows overlap between substrates based on a swath height errors of the substrates to reduce the artifacts caused by the swath height errors; and using a feedback processor operatively coupled to the substrate and the masking controller to determine actual swath heights produced by the substrates.

29. The computer-readable medium having computer-executable instructions for performing the process of claim 28, further comprising firing a predetermined number of nozzles per data row if a swath height error is not equal to zero.

30. The computer-readable medium having computer-executable instructions for performing the process of claim 29, further comprising disabling alternating ink ejection elements associated with nozzles in a data row in the overlapping region and increasing a total number of data rows of the substrates if the swath height error is greater than or equal to 1 unit, wherein 1 nozzle spacing unit is equal to a spacing between adjacent nozzles.

31. The computer-readable medium having computer-executable instructions for performing the process of claim 29, further comprising disabling alternating ink ejection elements associated with nozzles in a data row in the overlapping region and decreasing a total number of data rows of the substrates if the swath height error is less than equal to negative 1 unit, wherein 1 nozzle spacing unit is equal to a spacing between adjacent nozzles.

32. The computer-readable medium having computer-executable instructions for performing the process of claim 29, further comprising calibrating the substrates so that all the printhead modules print at the same time.

* * * * *